US007367330B2

(12) United States Patent
Yoshidome

(10) Patent No.: US 7,367,330 B2
(45) Date of Patent: May 6, 2008

(54) INTERNAL COMBUSTION ENGINE CONTROLLER

(75) Inventor: Manabu Yoshidome, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/493,536

(22) Filed: Jul. 27, 2006

(65) Prior Publication Data

US 2007/0023020 A1 Feb. 1, 2007

(30) Foreign Application Priority Data

Jul. 28, 2005 (JP) ..... 2005-218761

(51) Int. Cl.
*F02D 45/00* (2006.01)

(52) U.S. Cl. ..... 123/672; 123/703

(58) Field of Classification Search ..... 123/693, 123/672, 688, 304, 674, 703, 676, 677, 339.12, 123/339.29, 568.14, 568.22; 701/103, 105, 701/104, 109, 112, 113
See application file for complete search history.

(56) References Cited

U.S. PATENT DOCUMENTS 4,347,821 A * 9/1982 Saito ..... 123/699
4,365,604 A * 12/1982 Sone ..... 123/687
4,430,191 A * 2/1984 Sone et al. ..... 204/401
4,841,940 A * 6/1989 Uranishi et al. ..... 123/694
4,898,143 A * 2/1990 Fujimoto et al. ..... 123/568.22

FOREIGN PATENT DOCUMENTS

JP 2003-003903 1/2003

* cited by examiner

*Primary Examiner*—Willis R. Wolfe, Jr.
*Assistant Examiner*—Johnny H. Hoang
(74) *Attorney, Agent, or Firm*—Nixon & Vanderhye P.C.

(57) ABSTRACT

The internal combustion engine controller includes an oxygen concentration sensor outputting an electric signal having a value depending on an oxygen concentration in an exhaust gas flowing through an exhaust passage of an internal combustion engine, and a control unit controlling fuel injection amount depending on at least the electric signal, the control unit being capable of performing atmospheric learning to calibrate the oxygen concentration sensor. The control unit is configured to perform the atmospheric learning when a changing rate of the value of the electric signal is lowered from above a predetermined threshold rate to below the predetermined threshold rate after a time of start of cutoff of fuel supply to the engine.

11 Claims, 4 Drawing Sheets

INTERNAL COMBUSTION ENGINE CONTROLLER

CROSS-REFERENCE TO RELATED APPLICATION

This application is related to Japanese Patent Application No. 2005-218761 filed on Jul. 28, 2005, the contents of which are hereby incorporated by reference.

BACKGROUND OF THE INVENTION

1. Field of the Invention

The present invention relates to an internal combustion engine controller having a function of performing atmospheric learning in order to calibrate an oxygen concentration sensor detecting an oxygen concentration in an exhaust gas of an internal combustion engine.

2. Description of Related Art

Recent computerized automobiles are configured to control an air-fuel ratio in order to increase the cleaning factor of an exhaust gas cleaning catalyst on the basis of the output value of an oxygen concentration sensor installed in an exhaust passage.

The oxygen concentration sensor has a problem in that its sensing accuracy varies depending on manufacturing variation (individual difference), and deteriorates with the passage of time. Accordingly, it is common to perform atmospheric learning in which the oxygen concentration sensor is calibrated based on the assumption that the space around the oxygen concentration sensor installed in the exhaust passage is filled with the atmospheric air after the lapse of a predetermined wait time from a time when the fuel supply to the internal combustion engine is cut off, and the output value of the oxygen concentration sensor therefore indicates the atmospheric oxygen concentration.

It should be noted that a combusted gas remains in the upstream of the oxygen concentration sensor immediately after the fuel cutoff, and accordingly the oxygen concentration around the oxygen concentration sensor does not approach to the atmospheric oxygen concentration until the combusted gas is replaced by new air (atmospheric air). The time needed for the oxygen concentration around the oxygen concentration sensor to become substantially equal to the atmospheric oxygen concentration (referred to as delay time hereinafter) from the time of the start of the fuel cutoff depends on a running state of a vehicle on which the internal combustion is mounted. Accordingly, it is known to change the above described wait time depending on the engine rotational speed, vehicle speed, or gear shift position immediately before the time of the start of the fuel cutoff, as disclosed, for example, in Japanese Patent Publication No. 2003-3903.

However, the factors that affect the above described delay time are not limited to the engine speed, vehicle speed, and gear shift position immediately before the time of the start of the fuel cutoff. For example, in an internal combustion engine configured to return its exhaust gas from an exhaust passage to an air intake passage thereof, the delay time becomes long as the returning amount of the exhaust gas increases causing the amount of intake air to decrease. Accordingly, it is difficult to set the wait time to an optimum value in the conventional internal combustion engine controllers configured to change the wait time depending on the engine speed, vehicle speed, and gear shift position immediately before the time of the start of the fuel cutoff.

If the wait time is set shorter than the delay time, the atmospheric learning may be erroneously performed before the oxygen concentration around the oxygen concentration sensor becomes substantially equal to the atmospheric oxygen concentration. On the other hand, if the wait time is set longer than the delay time, the atmospheric learning may not be performed with a sufficiently high frequency.

SUMMARY OF THE INVENTION

The present invention provides an internal combustion engine controller including:

an oxygen concentration sensor outputting an electric signal having a value depending on an oxygen concentration in an exhaust gas flowing through an exhaust passage of an internal combustion engine; and a control unit controlling fuel injection amount depending on at least the electric signal, the control unit being capable of performing atmospheric learning to calibrate the oxygen concentration sensor;

wherein the control unit is configured to perform the atmospheric learning when a changing rate of the value of the electric signal is lowered from above a predetermined threshold rate to below the predetermined threshold rate after a time of start of cutoff of fuel supply to the engine.

The present invention also provides an internal combustion engine controller including:

an oxygen concentration sensor outputting an electric signal having a value depending on an oxygen concentration in an exhaust gas flowing through an exhaust passage of an internal combustion engine; and a control unit controlling a fuel injection amount depending on at least the electric signal, the control unit being capable of performing atmospheric learning to calibrate the oxygen concentration sensor;

wherein the control unit is configured to perform the atmospheric learning when a total volume of intake air sucked in and supplied to the engine since a time of start of cutoff of fuel supply to the engine exceeds a predetermined threshold volume.

The present invention also provides an internal combustion engine controller including:

an oxygen concentration sensor outputting an electric signal having a value depending on an oxygen concentration in an exhaust gas flowing through an exhaust passage of an internal combustion engine; and a control unit controlling a fuel injection amount depending on at least the electric signal, the control unit being capable of performing atmospheric learning to calibrate the oxygen concentration sensor;

wherein the control unit is configured to perform the atmospheric learning when a changing rate of the value of the electric signal is lowered from above a predetermined threshold rate to below the predetermined threshold rate after a time of start of cutoff of fuel supply to the engine, and a total volume of intake air sucked in and supplied to the engine since the time of the start exceeds a predetermined threshold volume.

According to the present invention, it is possible to accurately determine that the oxygen concentration around the oxygen concentration sensor has become equal to the atmospheric oxygen concentration, to thereby prevent the atmospheric learning from being erroneously performed, and to perform the atmospheric learning with a sufficiently high frequency.

Other advantages and features will become apparent from the following description including the drawings and claims.

PREFERRED EMBODIMENTS OF THE INVENTION

First Embodiment

Figure 1:
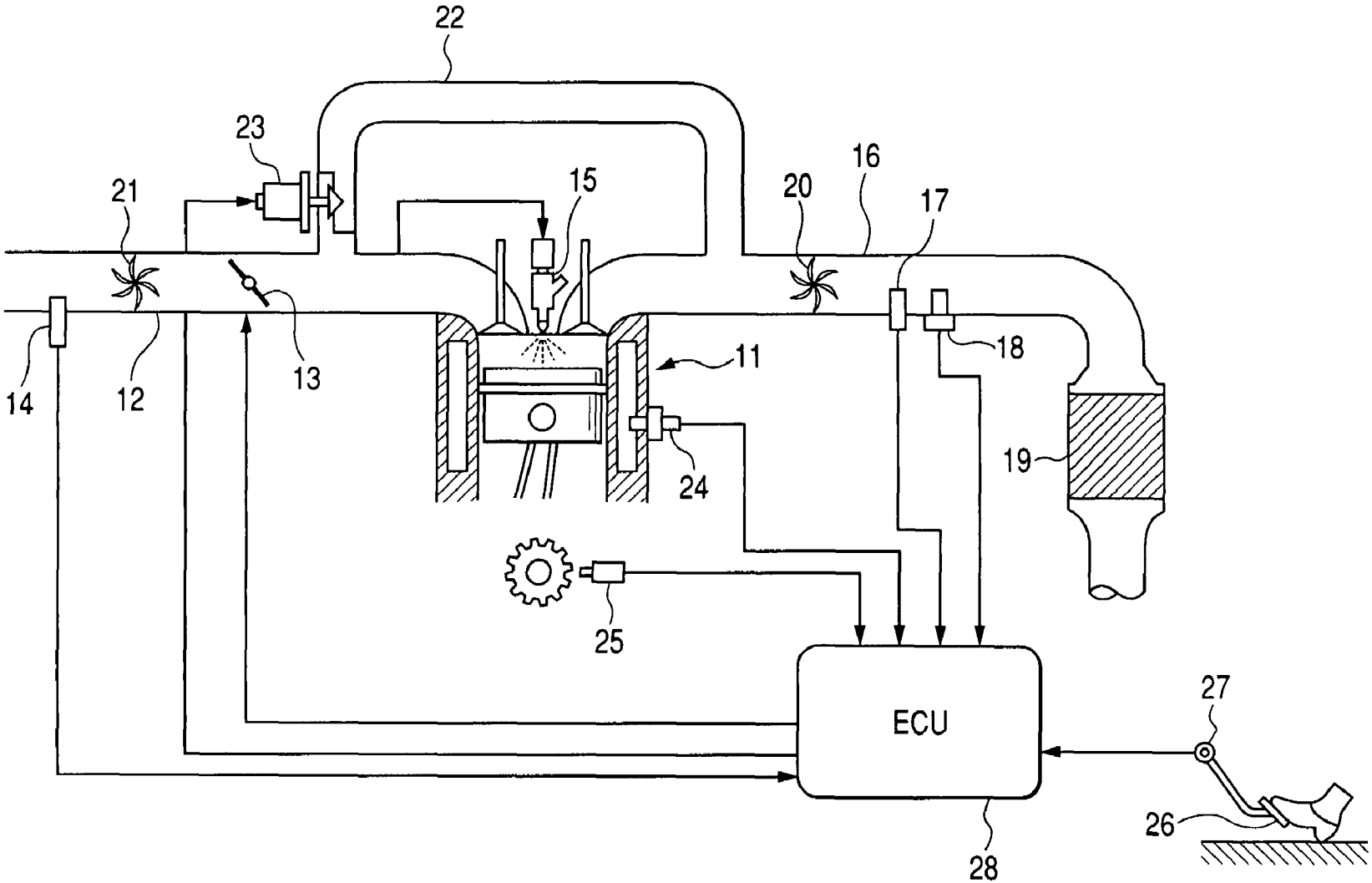
FIG. 1 is a diagram explaining a structure of an internal combustion engine controller according to a first embodiment of the invention.

FIG. 1 is a diagram explaining a structure of an internal combustion engine controller according to a first embodiment of the invention. The internal combustion engine controller, which is constituted by an oxygen concentration sensor 17 and an engine control unit (referred to as ECU hereinafter) 28, is used for controlling a diesel engine 11. In FIG. 1, the reference numeral 12 denotes an air intake pipe, 13 denotes a throttle valve installed in the air intake pipe 12, 14 denotes an intake air sensor for detecting a flow of intake air, and 16 denotes an exhaust pipe. The engine 11 is provided with a fuel injection valve 15 for each of its cylinders.

The oxygen concentration sensor 17, which is installed in the exhaust pipe 16, outputs a voltage whose value depends on the oxygen concentration in the exhaust gas of the engine 11.

An exhaust gas temperature sensor 18 is installed in the vicinity of the oxygen concentration sensor 17 within the exhaust pipe 16. A diesel particulate filter 19 for collecting particulates contained in the exhaust gas is installed downstream of the exhaust gas temperature sensor 18. The diesel particulate filter 19 is provided with a catalyst for cleaning NOx and HC contained in the exhaust gas.

A turbine 20 of a turbocharger is installed upstream of the oxygen concentration sensor 17 within the exhaust pipe 16. A compressor 21 coupled to the turbine 20 is installed upstream of the throttle valve 13 within the air intake pipe 12. An EGR (Exhaust Gas Recirculation) pipe 22 is connected to the upstream of the turbine 20 within the exhaust pipe 16 and to the downstream of the throttle valve 13 within the air intake pipe 12. An EGR valve 23 is installed midway of the EGR pipe 22 for controlling the circulating amount of the exhaust gas.

The engine 11 is provided with a cooling water temperature sensor 24 for detecting the temperature of engine cooling water, and a crank angle sensor 25 for detecting the rotational speed of the engine 11 at its cylinder block. An accelerator sensor 27 is installed to the accelerator pedal 26 for detecting a depressed amount of the accelerator pedal 26.

The output signals of the above described sensors are inputted to the ECU 28. The ECU 28 is constituted mainly by a microcomputer executing various programs stored in a ROM included therein.

More specifically, the ECU 28 executes a fuel injection control program in order to control the amount of fuel injected from the fuel injection valve 15 in accordance with the running state of the engine 11 (engine rotational speed, depressed amount of the accelerator pedal 26, oxygen concentration in the exhaust gas, etc.). The ECU 28 also executes an atmospheric learning control program in order to calibrate the oxygen concentration sensor 17.

Next, the atmospheric learning control program is explained with reference a timechart of FIG. 2 and a flowchart of FIG. 3.

Figure 2:
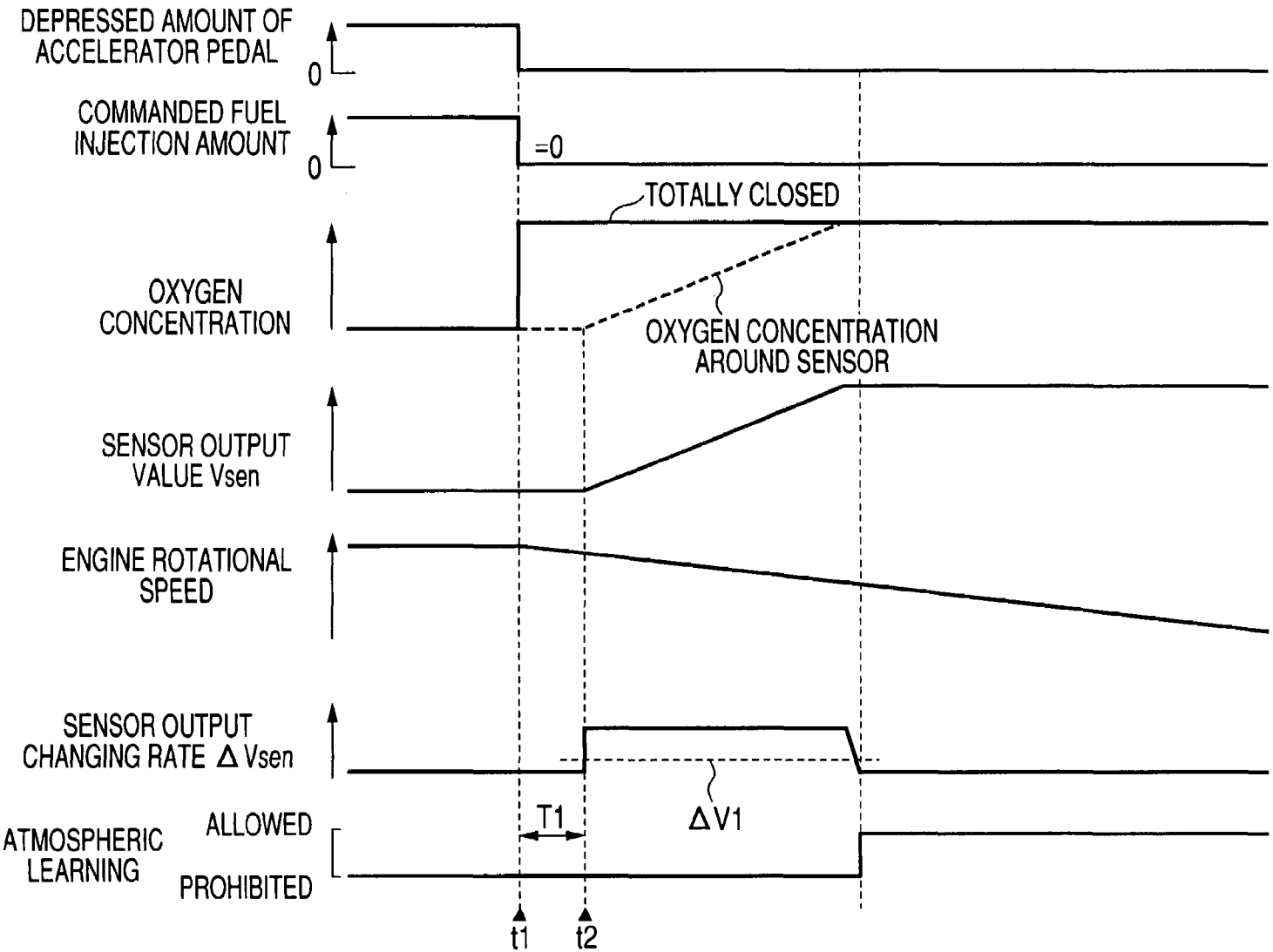
FIG. 2 is a timechart for explaining the timing at which atmospheric learning should be performed in the first embodiment after fuel supply to an internal combustion engine is cut off.

As shown in the timechart of FIG. 2, the output value Vsen of the oxygen concentration sensor 17 is substantially constant during the period from the time of the start of the fuel cutoff (t1 in FIG. 2) to the time when the exhaust gas around the oxygen concentration sensor 17 begins to be replaced by new air (t2 in FIG. 2). When the exhaust gas around the oxygen concentration sensor 17 begins to be replaced by new air, and accordingly the oxygen concentration around the oxygen concentration sensor 17 begins to change, the output value Vsen of the oxygen concentration sensor 17 begins to change. Thereafter, when the exhaust gas around the oxygen concentration sensor 17 is completely replaced by new air, and accordingly the oxygen concentration around the oxygen concentration sensor 17 becomes substantially constant, the output value Vsen of the oxygen concentration sensor 17 becomes substantially constant.

The timing at which the atmospheric learning should be performed can be determined taking account of the fact that, when the exhaust gas around the oxygen concentration sensor 17 is completely replaced by new air, the output value Vsen of the oxygen concentration sensor 17 becomes substantially constant, as described below.

Figure 3:
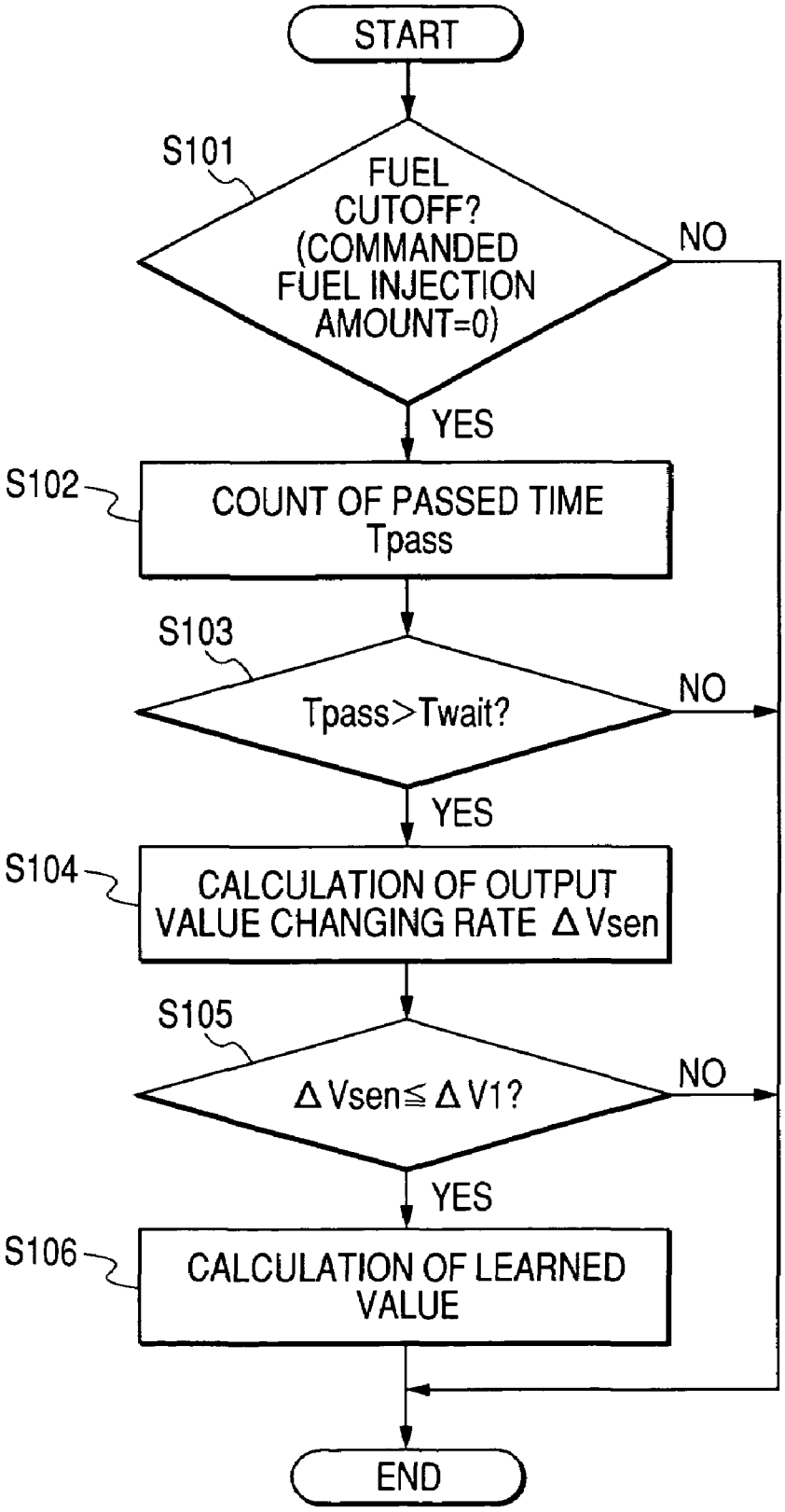
FIG. 3 is a flowchart showing an atmospheric learning control program executed by an engine control unit included in the internal combustion engine controller according to the first embodiment of the invention.

As shown in FIG. 3, the atmospheric learning control program starts by causing the ECU 28 to check at step S101 whether or not the engine 11 is in the fuel cutoff state. More specifically, if a commanded fuel injection amount which the ECU 28 calculates by executing the fuel injection control program is 0, it is determined that the engine 11 is in the fuel cutoff state. If the check result at step S101 is affirmative, the program proceeds to step S102 where the time Tpass passed since the time of the start of the fuel cutoff is counted.

At subsequent step S102, it is checked whether or not the passed time Tpass exceeds a predetermined wait time Twait (2 seconds, for example). This wait time Twait corresponds to the time needed for the changing rate ΔVsen (to be described later) of the output value of the oxygen concentration sensor 17 to exceed a predetermined threshold rate ΔV1 (to be described later) from the time of the start of the fuel cutoff (t1 in FIG. 2). The wait time Twait is set longer than the time period T1 (see FIG. 2) from the time of the start of the fuel cutoff (t1 in FIG. 2) to the time when the exhaust gas around the oxygen concentration sensor 17 begins to be replaced by new air (t2 in FIG. 2), in order to prevent the program from proceeding to step S105 immediately after the time of the start of the fuel cutoff when the output value of the oxygen concentration sensor 17 is substantially constant. The wait time Twait is determined experimentally, and stored in a ROM included in the ECU 28.

If the check result at step S103 is affirmative, the program proceeds to step S104 where the output value changing rate ΔVsen representing a changing amount of the output value Vsen of the oxygen concentration sensor 17 per a certain time period (100 ms, for example) is calculated.

At subsequent step S105, it is checked whether or not the output value changing rate ΔVsen calculated at step S104 is equal to or smaller than the predetermined threshold rate ΔV1. The threshold rate ΔV1 is set smaller than the value which the output value changing rate ΔVsen takes during the period from the time when the exhaust gas around the oxygen concentration sensor 17 begins to be replaced by new air (t2 in FIG. 2) to the time when it is completely replaced by new air. On the other hand, the threshold rate ΔV1 is set larger than the value which the output value changing rate ΔVsen takes after the exhaust gas around the oxygen concentration sensor 17 is completely replaced by new air.

Although it is likely that the output value changing rate ΔVsen becomes equal to or smaller than the threshold rate ΔV1 immediately after the time of the start of the fuel cutoff, the program can be prevented from proceeding to step S105 immediately after the time of the start of the fuel cutoff thanks to the provision of step S103.

Accordingly, if the check result at step S105 is affirmative, it can be assumed that the exhaust gas around the oxygen concentration sensor 17 has been completely replaced by new air, and the oxygen concentration around the oxygen concentration sensor 17 is therefore equal to the atmospheric oxygen concentration. The threshold rate ΔV1 is determined experimentally, and stored in the ROM included in the ECU 28.

If the check result at step S105 is affirmative, the program proceeds to step S106 where the atmospheric learning is performed to complete the atmospheric learning control process. More specifically, at step S106, a correction coefficient (learned value) C according to which the output value of the oxygen concentration sensor 17 is corrected is calculated on the basis of the ratio between the current output value Vsen of the oxygen concentration sensor 17 and a value Vstd which a standard oxygen concentration sensor with no aged deterioration will output when placed in the atmospheric air. The calculated correction coefficient C (=Vsen/Vstd) is stored in a non-volatile rewritable memory such as a backup RAM included in the ECU 28. The value Vstd of the standard oxygen concentration sensor may be stored in the ROM of the ECU 28.

The ECU 28 corrects the output value Vsen of the oxygen concentration sensor 17 by use of the correction coefficient C into a true output value Vr (=Vsen/C) from which the effects of the aged deterioration and manufacturing variation of the oxygen concentration sensor 17 have been removed. The true output value Vr is used for the fuel injection control.

As explained above, in this embodiment, the assumption is made as to whether or not the oxygen concentration around the oxygen concentration sensor 17 has become equal to the atmospheric oxygen concentration, taking account of the fact that when the exhaust gas around the oxygen concentration sensor 17 is completely replaced by new air, the output value of the oxygen concentration sensor 17 becomes substantially constant. Accordingly, with this embodiment, it is possible to accurately determine that the oxygen concentration around the oxygen concentration sensor 17 has become equal to the atmospheric oxygen concentration, to thereby prevent the atmospheric learning from being erroneously performed.

In addition, by promptly making the determination that the oxygen concentration around the oxygen concentration sensor 17 has become equal to the atmospheric oxygen concentration on the basis of the output value of the oxygen concentration sensor 17, it becomes possible to perform the atmospheric learning with a sufficiently high frequency.

Second Embodiment

Next, an internal combustion engine controller according to a second embodiment of the invention is described below. The second embodiment has the same structure as the first embodiment, however, the second embodiment performs a different atmospheric learning control program.

Figure 4:
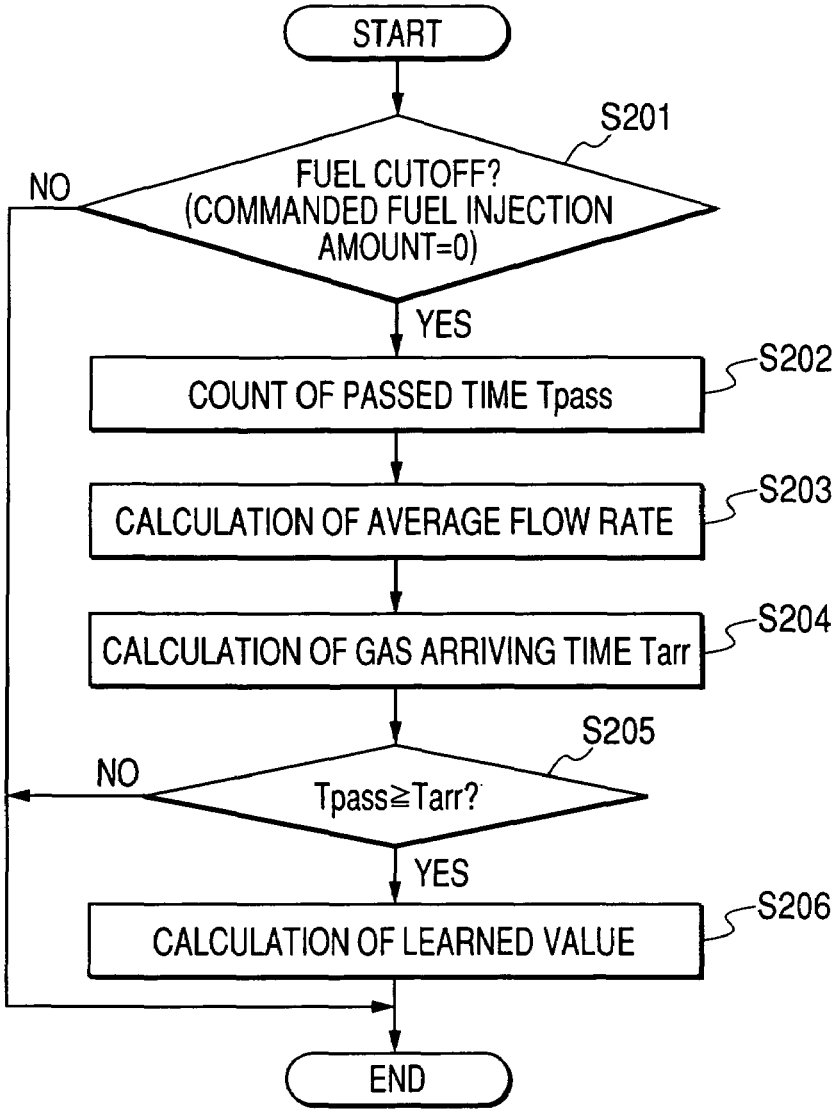
FIG. 4 is a flowchart showing an atmospheric learning control program executed by an engine control unit included in an internal combustion engine controller according to a second embodiment of the invention.

FIG. 4 is a flowchart showing the atmospheric learning control program performed by the ECU 28 of the internal combustion engine controller according to the second embodiment of the invention.

As shown in FIG. 4, the atmospheric learning control program starts by causing the ECU 28 to check at step S201 whether or not the engine is in the fuel cutoff state. More specifically, if the commanded fuel injection amount which the ECU 28 calculates by executing the fuel injection control program is 0, it is determined that the engine is in the fuel cutoff state. If the check result at step S201 is affirmative, the time Tpass passed since the time of the start of the fuel cutoff is counted at step S202.

At subsequent step S203, the average flow rate Qave of the intake air is calculated by dividing the air intake flow that has been integrated over the period since the time of the start of the fuel cutoff by the passed time Tpass.

After that, the program proceeds to step S204 where the time needed for a gas within the cylinder of the engine whose oxygen concentration has become substantially the same as the atmospheric oxygen concentration to arrive at the oxygen concentration sensor 17 from the time of the start of the fuel cutoff (referred to as arriving time Tarr thereafter) on the basis of the average flow rate Qave calculated at step S203.

Figure 5:
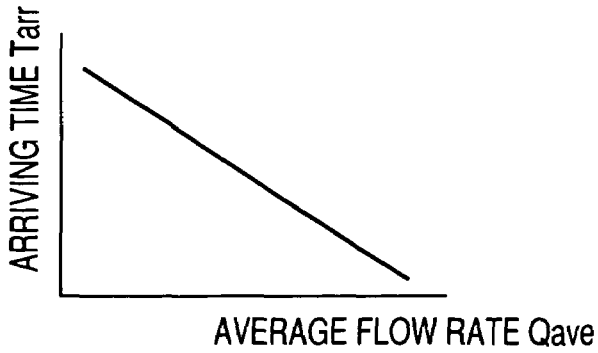
FIG. 5 is a graph showing a relationship between an average flow rate of intake air supplied to an internal combustion engine and the time needed for the atmospheric air to arrive at an oxygen concentration sensor installed in an exhaust pipe of the engine.

FIG. 5 shows a relationship between the average flow rate Qave and the arriving time Tarr, which can be determined experimentally. A map defining the relationship shown in FIG. 5 is stored in the ROM of the ECU 28.

After step S204, the program proceeds to step S205 where the assumption that a gas within the cylinder of the engine whose oxygen concentration has become substantially the same as the atmospheric oxygen concentration has arrived at the oxygen concentration sensor 17 is made, if the passed time Tpass is detected to be equal to or larger than the arriving time Tarr, which means that the total volume or the integrated flow of the intake air that has been sucked in since the time of the start of the fuel cutoff amounts to a certain value.

If the check result at step S205 is affirmative, the program proceeds to step S206 where the atmospheric learning is performed to complete the atmospheric learning process. At step S206, the correction coefficient C is calculated and stored in the memory of the ECU 28, as in the case of the first embodiment.

As explained above, in this embodiment, the assumption that the oxygen concentration around the oxygen concentration sensor 17 has become equal to the atmospheric oxygen concentration is made on the basis of the total volume or the integrated flow of the intake air that has been sucked in since the time of the start of the fuel cutoff.

Since the time needed for a gas within the cylinder of the engine whose oxygen concentration has become substantially the same as the atmospheric oxygen concentration to arrive at the oxygen concentration sensor 17 has a strong correlation with the total volume of the intake air that has been sucked in since the time of the start of the fuel cutoff, the internal combustion engine controller of this embodiment can detect at an accurate timing that the oxygen concentration around the oxygen concentration sensor 17 has become equal to the atmospheric oxygen concentration without being affected by the variation of the exhaust gas flow. Accordingly, it becomes possible to prevent the atmospheric learning from being erroneously performed, and to perform accurately the atmospheric learning with a sufficiently high frequency.

The second embodiment may be so configured as to make the assumption that a gas within the cylinder of the engine whose oxygen concentration has become substantially the same as the atmospheric oxygen concentration has arrived at the oxygen concentration sensor 17 when the total volume of the intake air that has been sucked in since the time of the start of the fuel cutoff exceeds a certain threshold instead of when the passed time Tpass exceeds the predetermined arriving time Tarr.

Since the intake air expands in the exhaust pipe 16 by the heat of the exhaust system, the total volume or the average flow rate Qave of the intake air may be corrected depending on the temperature of the exhaust gas detected by the exhaust gas temperature sensor 18 in order to increase the reliability of the assumption that the oxygen concentration around the oxygen concentration sensor 17 has become equal to the atmospheric oxygen concentration.

In a case where a sensor for detecting the pressure of the exhaust gas is installed in the exhaust pipe 16, the total volume or the average flow rate Qave of the intake air may be corrected depending on the detected pressure of the exhaust gas in order to increase the reliability of the assumption. It is a matter of course that the total volume or the average flow rate Qave of the intake air may be corrected depending on both the detected temperature and the detected pressure of the exhaust gas.

OTHER EMBODIMENT

The assumption that the oxygen concentration around the oxygen concentration sensor 17 has become equal to the atmospheric oxygen concentration may be made when the changing rate ΔVsen of the output value of the oxygen concentration sensor 17 is detected to be equal to or smaller than the predetermined threshold rate ΔV1 (YES at step S105 in FIG. 3), and the passed time Tpass is detected to be equal to or larger than the arriving time Tarr (YES at step S205 in FIG. 4).

The above explained preferred embodiments are exemplary of the invention of the present application which is described solely by the claims appended below. It should be understood that modifications of the preferred embodiments may be made as would occur to one of skill in the art.

What is claimed is:

1. An internal combustion engine controller comprising:

an oxygen concentration sensor outputting an electric signal having a value depending on an oxygen concentration in an exhaust gas flowing through an exhaust passage of an internal combustion engine; and a control unit controlling a fuel injection amount depending on at least said electric signal;

wherein said control unit is configured to perform atmospheric learning to calibrate a relationship between said electric signal outputted from said oxygen concentration sensor and said oxygen concentration in said exhaust gas when a changing rate of said value of said electric signal is lowered from above a predetermined threshold rate to below said predetermined threshold rate after a time of start of cutoff of fuel supply to said engine.

2. The internal combustion engine controller according to claim 1, wherein said control unit includes:

a function of measuring a passed time since the time of said start;

a function of detecting whether or not said measured passed time exceeds a wait time needed for said changing rate to exceed said predetermined threshold rate from the time of said start; and a function of detecting whether or not said changing rate is lowered below said predetermined threshold rate after said measured passed time exceeds said wait time.

3. An internal combustion engine controller comprising:

an oxygen concentration sensor outputting an electric signal having a value depending on an oxygen concentration in an exhaust gas flowing through an exhaust passage of an internal combustion engine; and a control unit controlling a fuel injection amount depending on at least said electric signal, said control unit being capable of performing atmospheric learning to calibrate said oxygen concentration sensor;

wherein said control unit is configured to perform said atmospheric learning when a total volume of intake air sucked in and supplied to said engine since a time of start of cutoff of fuel supply to said engine exceeds a predetermined threshold volume.

4. The internal combustion engine controller according to claim 3, wherein said control unit includes:

a function of calculating an integrated flow of said intake air since the time of said start; and a function of determining whether or not said calculated integrated flow exceeds said predetermined threshold volume.

5. The internal combustion engine controller according to claim 3, wherein said control unit includes:

a function of measuring a passed time since the time of said start;

a function of calculating an average flow rate of said intake air after the time of said start;

a function of calculating an arriving time needed for a gas within a cylinder of said engine to arrive at said oxygen concentration sensor from the time of said start on the basis of said calculated average flow rate; and a function of making, upon detecting that said measured passed time exceeds said calculated arriving time, an assumption that said total volume of said intake air exceeds said predetermined threshold volume.

6. The internal combustion engine controller according to claim 3, wherein said control unit is configured to correct said calculated integrated flow on the basis of at least one of a temperature and a pressure of said exhaust gas flowing through said exhaust passage.

7. An internal combustion engine controller comprising:

an oxygen concentration sensor outputting an electric signal having a value depending on an oxygen concentration in an exhaust gas flowing through an exhaust passage of an internal combustion engine; and a control unit controlling a fuel injection amount depending on at least said electric signal, said control unit being capable of performing atmospheric learning to calibrate said oxygen concentration sensor;

wherein said control unit is configured to perform said atmospheric learning when a changing rate of said value of said electric signal is lowered from above a predetermined threshold rate to below said predetermined threshold rate after a time of start of cutoff of fuel supply to said engine, and a total volume of intake air sucked in and supplied to said engine since the time of said start exceeds a predetermined threshold volume.

8. The internal combustion engine controller according to claim 7, wherein said control unit includes:

a function of measuring a passed time since the time of said start;

a function of detecting whether or not said measured passed time exceeds a wait time needed for said changing rate to exceed said predetermined threshold rate from the time of said start; and a function of detecting whether or not said changing rate is lowered below said predetermined threshold rate after said measured passed time exceeds said wait time.

9. The internal combustion engine controller according to claim 7, wherein said control unit includes:

a function of calculating an integrated flow of said intake air since the time of said start; and a function of determining whether or not said calculated integrated flow exceeds said predetermined threshold volume.

10. The internal combustion engine controller according to claim 7, wherein said control unit includes:

a function of measuring a passed time since the time of said start;

a function of calculating an average flow rate of said intake air after the time of said start;

a function of calculating an arriving time needed for a gas within a cylinder of said engine to arrive at said oxygen concentration sensor from the time of said start on the basis of said calculated average flow rate; and a function of making, upon detecting that said measured passed time exceeds said calculated arriving time, an assumption that said total volume of said intake air exceeds said predetermined threshold volume.

11. The internal combustion engine controller according to claim 7, wherein said control unit is configured to correct said calculated integrated flow on the basis of at least one of a temperature and a pressure of said exhaust gas flowing through said exhaust passage.

* * * * *